US005112412A

United States Patent [19]

Plata et al.

[11] Patent Number: 5,112,412

[45] Date of Patent: May 12, 1992

[54] COOLING OF CAST BILLETS

[75] Inventors: Miroslaw Plata, Sion; Jean-Jaques Theler, Sierre, both of Switzerland

[73] Assignee: Alusuisse-Lonza Services Ltd., Zurich, Switzerland

[21] Appl. No.: 612,890

[22] Filed: Nov. 13, 1990

[30] Foreign Application Priority Data

Nov. 23, 1989 [CH] Switzerland ..... 4215/89

[51] Int. Cl.[5] ..... C21D 1/00

[52] U.S. Cl. ..... 148/688; 134/15; 148/20.6; 148/128; 148/549; 164/455

[58] Field of Search ..... 148/13, 28, 20.6, 128; 164/455; 134/15

[56] References Cited

U.S. PATENT DOCUMENTS 3,753,793 8/1973 Wagener et al. ..... 148/13

*Primary Examiner*—R. Dean

*Assistant Examiner*—Robert R. Koehler

*Attorney, Agent, or Firm*—Bachman & LaPointe

[57] ABSTRACT

The method and the apparatus serve to cool cast billets made of an aluminum alloy after a homogenizing anneal.

The billets emerging from a full-annealing furnace continuously one after the other in the longitudinal direction at a first temperature are guided in-line through a spray unit at a program-controlled feed rate and while being sprayed on all sides with the cooling medium in a program-controlled manner to reach an adjustable surface temperature. The internal and surface temperature of the billets are equalized a short time after leaving the spray unit.

The spray unit for the billets (16) passing through in-line is equipped over its entire length and over the entire periphery of its inner space with nozzles which can be adjusted as a whole, in groups or individually.

13 Claims, 2 Drawing Sheets

COOLING OF CAST BILLETS

BACKGROUND OF THE INVENTION

The invention relates to a method of cooling cast billets made of an aluminum alloy after a homogenizing anneal, and an apparatus for carrying out the method.

In aluminum foundries, billets, in particular large-size slugs and rolling ingots, are produced by known continuous casting processes. During casting, the metal solidifies in a cooled mold only in the region of the surface. After leaving the mold, the billet is dimensionally stable, but is still liquid in the interior. The continuously lowered billet is therefore intensively cooled further.

The cooling-down during the continuous casting is orientated towards allowing the casting process to proceed optimally with the solidification process. There is little or only slight scope for metallurgical concerns specific to the alloy.

The solidified, cast billets are therefore heated again as a rule and subjected to a homogenizing anneal in a full-annealing furnace. This can be done in the foundry or in the further-processing rolling mill or press shop, even after storage of the billets.

After the homogenizing anneal, the billets, if they are not directly hot-worked by the producer of the semifinished product, are cooled down, for example rapidly by immersing in water or slowly in air, depending on the alloy or application. These known cooling-down methods after the homogenizing anneal have the disadvantage that they proceed in an uncontrolled or poorly controlled manner.

The object of the present invention is to create a method and an apparatus of the type discussed above with which fully annealed billets can be cooled down in an automated and controlled manner in accordance with the alloy composition, the cross-section and the specific use.

SUMMARY OF THE INVENTION

With regard to the method, the object is achieved according to the invention in that the billets emerging from a full-annealing furnace continuously one after the other in the longitudinal direction at a first temperature are guided in-line through a spray unit at a program-controlled feed rate and while being sprayed on all sides with a cooling medium in a program-controlled manner to reach an adjustable surface temperature, the internal and surface temperature of the billets being equalized a short time after leaving the spray unit.

When AlMgSi alloys are cooled down, the billets cooled down in the spray unit are guided in-line through a subsequent insulated receptacle, a plurality of billets remaining stored in the receptacle. In practice, this receptacle is conceived mostly for accommodating 10–30 billets, e.g. in the form of a rotary drum, the billet fed in first being discharged when the receptacle is full.

Billets removed from the receptacle can be supplied after heating to a press or a hot-rolling mill and hot-worked into a semifinished product. Furthermore, billets from an insulated receptacle can be cooled down to room temperature according to methods which are of no further interest here.

Metals, especially aluminum and aluminum alloys, have a high thermal conductivity. Local cooling spreads rapidly in a metallic body and equalizes the temperature over the entire body after a relatively short time.

The feed rate with which the billets are guided in-line through the spray unit is preferably clearly higher than the thermal diffusion rate, about 10 cm/min,. caused by the high thermal conductivity of the aluminum alloy. In practice, the feed rate of the billets guided in-line through the spray unit is up to 5 m/min, in particular 1–3 m/min. Therefore the thermal diffusion in the longitudinal direction is negligible; only the transverse cooling is of importance.

The feed rate of a billet is preferably kept constant.

For technical and economic reasons, finely atomized water is primarily used as the cooling medium, with which air is preferably admixed. The air portion is high during slow cooling-down. The water quantity is conveniently set in such a way that the water is virtually completely vaporized after striking a billet. This can be achieved in a particularly advantageous manner at a droplet size under 100 μm.

With regard to the time sequence, the total quantity of the cooling medium, which total quantity governs the cooling capacity, can be sprayed on uniformly or in accordance with a desired curve. In particular embodiments, however, the cooling medium can also be applied in a pulsating manner, the supply of the cooling medium between the impulses being interrupted or reduced. By a pulsating supply of the cooling medium, as by control of the entire water quantity, the cooling capacity can be metered.

Furthermore, in a preferred variant of the invention, the spraying direction and the spraying cone of the cooling medium of an air-water nozzle can be controlled by process-controlled change of the air supplied at two locations, as a result of which a better balanced heat flow develops by means of a pendulcus pivoting movement of the supplied cooling medium perpendicularly to the feed direction of the billets. By the feed movement of the billets, the non-uniform impingement through a constant spraying cone of the nozzle is compensated only in the longitudinal direction but not in the transverse direction.

The heat transfer during cooling with a sprayed-on air-water mixture has been examined with the aid of tests using a simulator. The measuring results have been analyzed by a computer and evaluated in practice with the preparation of desired curves.

With regard to the periphery, in particular in billets having a circular cross-section, the cooling medium can be supplied in a regular manner. In long rectangular or other sizes differing greatly from a circular or regular, polygonal cross-sectional shape, the cooling medium can be sprayed on along the periphery with different intensity.

The temperature zone is preferably distributed homogeneously during cooling so that no or only minimal deformations, stresses or cracks form.

Finally, the cooling intensity can also be adjusted in the longitudinal direction of the spray unit in accordance with a desired curve. Thus the billets can be cooled differently but under control.

The process control according to the invention, also called program control, comprises, for example, the temperature at the outlet of the full-annealing furnace, the feed rate and the nature, quantity and distribution of the cooling medium, and in particular also the pendulous pivoting of the spraying cone of the cooling medium. These parameters are process-controlled by the measurement of the surface temperature of the billet at the outlet of the spray unit.

The billets homogenized in the full-annealing furnace are preferably guided out of the furnace at a temperature below the solidus temperature of 400° C.-600° C. into the spray unit. In AlMgSi alloys, which are cooled in stages, this temperature is, for example, around 580° C.; in hard alloys not cooled in stages, it is, for example, around 500° C.

In the spray unit, the homogenized billets are cooled down in a cooling phase to a predetermined surface temperature which, after an equalizing phase, leads to an equalized internal and surface temperature. This equalization temperature is preferably around 310° C.-350° C. in AlMgSi alloys.

In the insulated receptacle directly adjoining the spray unit during the cooling of AlMgSi alloys, where the billets are held in interim storage, a possibly incomplete equalizing phase first of all runs its full course. Here, the billets are held preferably for 20-60 minutes, in particular for about 30 minutes.

With regard to the apparatus, the object is achieved according to the invention in that, arranged in-line, it comprises a full-annealing furnace and a spray unit can be controlled by process control, the spray unit conceived after the full-annealing furnace for billets passing through one after the other in the longitudinal direction being equipped over its entire length and over the entire periphery of its inner space with nozzles for the cooling medium, which nozzles can be adjusted as a whole, in groups or individually.

This comprises primarily the switching on and off of the nozzles as a whole, in groups or individually but preferably also the corresponding regulation of the rate of flow of the cooling medium. The arrangement in groups conveniently also comprises the feed of the nozzles in sectors. Thus all desired curves necessary for carrying out the billet cooling can be followed in the spray unit.

BRIEF DESCRIPTION OF THE INVENTION

The invention is described in greater detail with reference to exemplary embodiments which are shown in the drawings. In the drawings:

FIG. 1 schematically shows an in-line arrangement having an insulated receptacle for cooling in stages, FIG. 2 schematically shows a longitudinal section through a spray unit, FIG. 3 schematically shows a cross-section along line III—III in FIG. 2, FIG. 4 schematically shows a temperature profile for an AlMgSi alloy having cooling in stages, FIG. 5 schematically shows a temperature profile for a hard alloy, and FIG. 6 schematically shows an axial section through an air-water nozzle.

DETAILED DESCRIPTION

Figure 1:
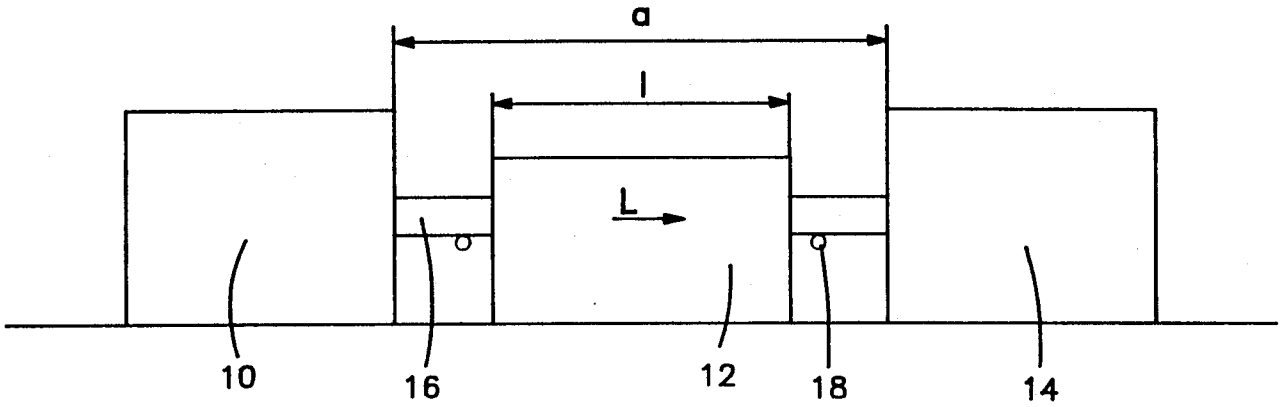

The diagrammatic sketch of an in-line cooling system according to FIG. 1 shows a full-annealing furnace 10, a spray unit 12 and an insulated receptacle 14 arranged directly one behind the other. Shown in between is a continuous billet 16, which can be a slug or a rolling ingot This billet 16 is supported on indicated running rollers 18.

The length 1 of the spray unit 12 is drawn greatly exaggerated in comparison with the corresponding dimensions of the full-annealing furnace 10 and insulated receptacle 14. The length 1 is in the region of 1-5 m. The length of the insulated receptacle 14 must be sufficient to receive the longest billet 16.

In the present example, the distance a of the full-annealing furnace 10 from the insulated receptacle 14 of drum-like design is about 2 m at a length 1 of the spray unit 12 of about 1.5 m.

The process control, essential for the operating sequence of the method according to the invention, by means of a computer, together with electrical conductors to the parts of the plant, has been omitted for the sake of clarity.

Figure 2:
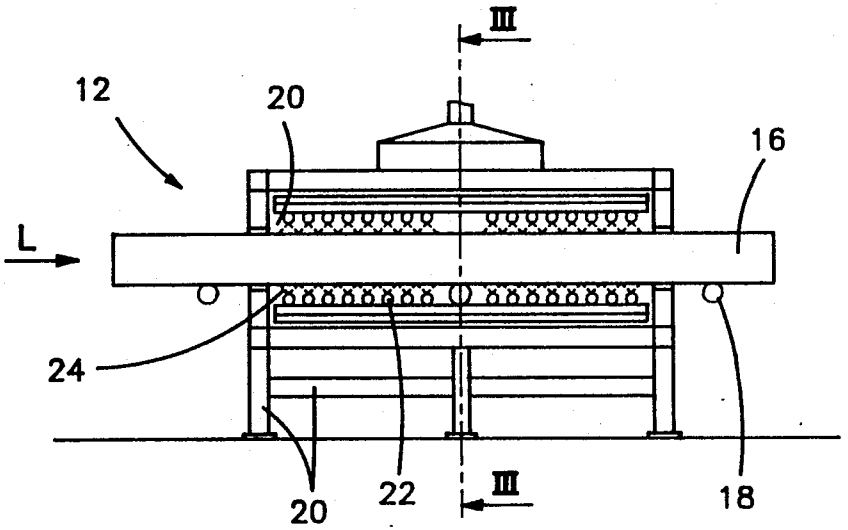
Figure 3:
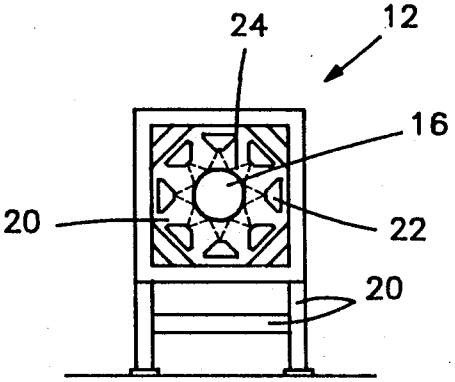

Details of the spray unit 12, which is arranged on a supporting frame 20, are apparent from FIGS. 2 and 3. Nozzles 22 for the cooling medium 24 are arranged in the longitudinal direction L in such a way as to be interrupted merely by one running roller 18 and over the entire periphery of the inner space of the spray unit 12. In the present case, the spray unit 12 comprises a total of 128 nozzles; in other cooling units even up to 200 or more nozzles can be arranged. The nozzles are grouped in annular collectors, the quantity of cooling medium being controllable in collectors. As already mentioned, these nozzles 22 can be program-controlled, switched on and off and also adjusted with regard to the rate of flow of cooling medium 24. A microprocessor or computer (not shown) can activate as a whole, in groups or individually, the drive members of the metering devices for the cooling medium 24 of the individual nozzles 22.

Figure 4:
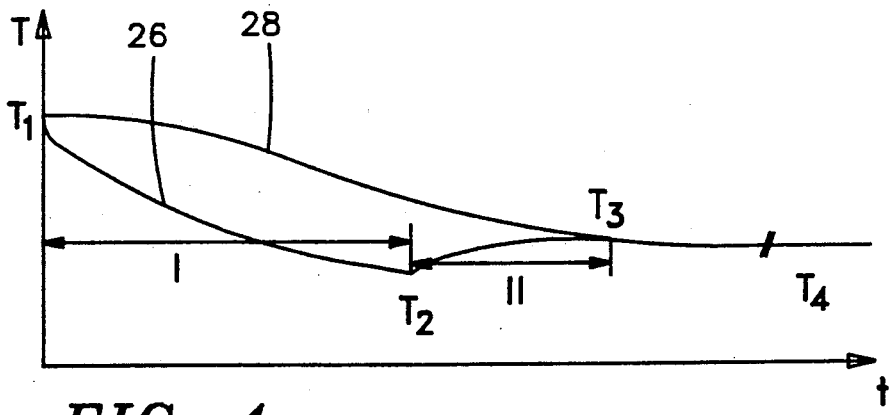
Figure 5:
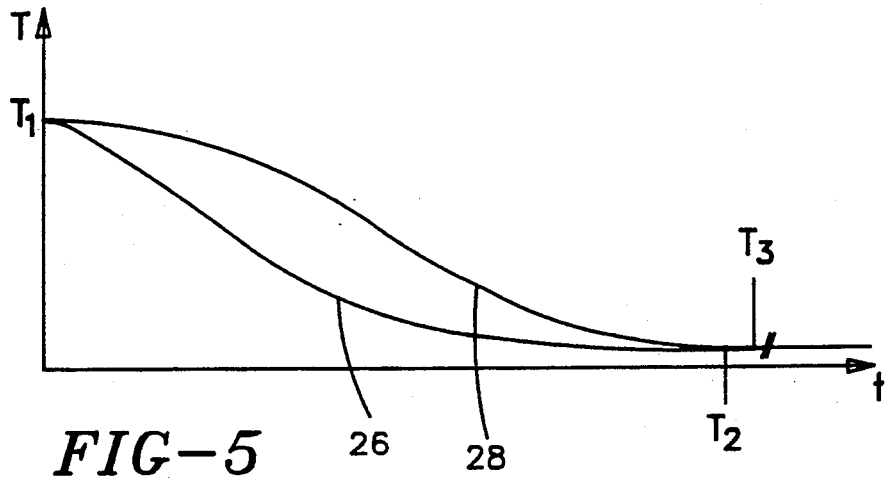

In FIGS. 4 and 5, the time t is plotted on the abscissa and the temperature T for a billet point moving in-line is plotted on the ordinate. FIG. 4 shows cooling in stages for an AlMgSi alloy; FIG. 5 shows cooling-down without stages for hard alloys in a spray unit 12 (FIGS. 1-3).

In FIG. 4, the cooling starts at a first temperature $T_1$, the homogenizing temperature of about 580° C. in the full-annealing furnace. This temperature changes only marginally until entry into the spray unit. The start of cooling is shown at time t=0. During the cooling phase I, the passage time of the abovementioned point of the billet through the spray unit, the temperature in the innermost region of the billet falls substantially slower than at the surface, in accordance with the temperature profiles 26 and 28.

Upon leaving the spray unit, the surface temperature has reached the predetermined and measured value $T_2$. Depending on the abovementioned parameters, the cooling phase I usually lasts for about 20 sec to 2 min in practice. In the present example, the temperature $T_2$ is around 250° C. After the billet point considered in FIG. 1 has left the spray unit at a temperature $T_2$ and is thus removed from the effect of the cooling medium, the surface temperature rises during the equalizing phase II until the temperature $T_3$, the equalizing temperature of the temperature profile 26 for the surface and of the temperature profile 28 for the central inner region of the billet, is reached. The curves 26 and 28 can be calculated in advance by numerical simulation.

The equalizing phase II between the temperatures $T_2$ and $T_3$ is shortest during slow cooling-down and in the case of a small billet cross-section and longest during rapid cooling-down and in the case of a large billet cross-section. During a short equalizing phase II, the equalizing temperature $T_3$ can be reached even before the billet runs into the insulated receptacle; during longer equalizing phases II, complete equalization of temperature between surface and interior of the billet is effected only in the insulated receptacle.

The equalizing temperature $T_3$ is around 330° C. In the insulated receptacle, the billet is cooled down slowly to about 300° C. on account of insulation losses.

The holding duration of the billets in the insulated receptacle is a multiple of the duration of cooling phase I and equalizing phase II together; in the present case it is about 30 min.

In an embodiment according to FIG. 5, a billet made of a hard alloy having a homogenizing temperature $T_1$ of about 500° C. is cooled down continuously according to a programmed desired curve to a final temperature $T_2$ of about 150° C. The equalization of temperature between the surface and the interior is virtually complete after the cooling-down in the spray unit.

Figure 6:
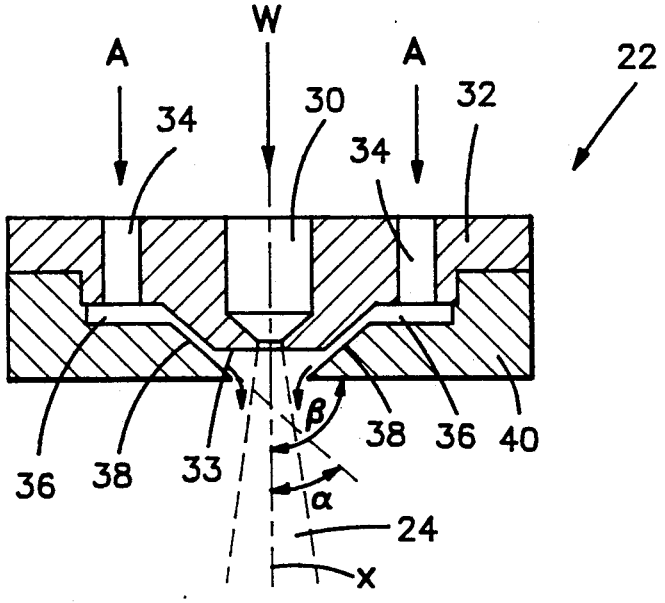

A nozzle 22 of a spray unit 12 (FIGS. 2, 3), which nozzle 22 is shown in FIG. 6, consists of a part 32 having a bore 30 for the water W, which bore 30 narrows at an angle of 45° and forms a nozzle opening 33. Furthermore, two bores- 34 for the air supply A which lie diametrically opposite one another pass through the part 32. The part 32, while forming ring-segment-shaped hollow spaces 36 and adjoining air-conducting channels 38, is fitted into a mating piece 40. The air-conducting channels 38 enclose an angle $\alpha$ of 45° with the nozzle axis X.

By variable pressurizing of the bores 34, the direction of the cooling medium 24 atomized in a cone shape can be varied within a wide range, the angle $2\beta$. By continuously changing pressurizing of the air-conducting channels 38, a pendulous pivoting movement of the spraying cone of the pressure medium 24, with nozzle 22 not moving, results.

With a nozzle 22 according to FIG. 6, the rate of air flow can be reduced several times over compared with a jet-mixing method on the basis of a Venturi nozzle. In addition, it has been found that, by the atomizing of the water jet W and acceleration of the droplets due to the introduced compressed air A, an exceptionally uniform distribution of the cooling intensity over the impingement area of the liquid mist on the surface of the billet to be cooled results when the pendulous pivoting movement of the spraying cone is effected.

We claim:

1. Method of cooling cast billets made of an aluminum alloy after a homogenizing anneal, which comprises:

providing billets having a surface and an internal portion;

feeding the billets emerging from a full-annealing furnace continuously one after the other in the longitudinal direction at a first temperature ($T_1$) to a spray unit;

guiding said billets in-line through the spray unit at a program-controlled feed rate and while being sprayed on the surface with a cooling medium in a program-controlled manner to reach an adjustable surface temperature ($T_2$); and equalizing the internal and surface temperature of the billets after leaving the spray unit.

2. Method according to claim 1 wherein the billets cooled down in the spray unit are made of an AlMgSi alloy and are guided in-line through a subsequent insulated receptacle, a plurality of billets remaining in intermi storage in this receptacle until discharge.

3. Method according to claim 1 wherein the billets are guided in-line through the spray unit at feed rate which is above the thermal diffusion caused by their thermal conductivity.

4. Method according to claim 3 wherein said feed rate is up to 5 m/min.

5. Method according to claim 1 wherein cooling is carried out in the spray unit with a cooling medium of an air-water mixture.

6. Method according to claim 5 wherein the water is completely vaporized after striking a billet.

7. Method according to claim 1 wherein the cooling medium is spraying on uniformly in a pulsating manner.

8. Method according to claim 7 wherein said billets are sprayed with an air-water nozzle and wherein the spraying direction (X) and the spraying cone of the cooling medium of the air-water nozzle are controlled by change of the air supplied at two locations, as a result of which a better balanced heat flow develops by means of a pendulous pivoting movement of the supplied cooling medium at an angle ($\beta$) perpendicularly to the feed direction (L) of the billets.

9. Method according to claim 1 wherein homogenized billets emerge from the full-annealing furnace at a first temperature ($T_1$) below the solidus temperature of the alloy of 400° C.–600° C. and are guided into the spray unit.

10. Method according to claim 1 wherein homogenized billets made of an AlMgSi alloy are cooled down in the spray unit in a cooling phase (I) to a surface temperature ($T_2$), leading after an equalizing phase (II) to an equalized internal and surface temperature ($T_3$) of 310° C.–350° C.

11. Method according to claim 10 wherein the billets cooled down in the spray unit are subsequently held in the insulated receptacle for 20–60 minutes.

12. Method according to claim 11 wherein said billets are held in said insulated receptacle for about 30 minutes.

13. Method according to claim 1 wherein homogenized billets made of a hard alloy are cooled down in a controlled manner in the spray unit to a final temperature.

* * * * *